US009268308B2

(12) United States Patent
Forsey et al.

(10) Patent No.: US 9,268,308 B2
(45) Date of Patent: Feb. 23, 2016

(54) TIMEPIECE

(71) Applicant: COMPLITIME SA, La Chaux-de-Fonds (CH)

(72) Inventors: Stephen Forsey, Les Brenets (CH); Lena Dupan, Le Locle (CH)

(73) Assignee: COMPLITIME SA, La Chaux-de-Fonds (CH)

( * ) Notice: Subject to any disclaimer, the term of this patent is extended or adjusted under 35 U.S.C. 154(b) by 0 days.

(21) Appl. No.: 14/434,088

(22) PCT Filed: Oct. 14, 2013

(86) PCT No.: PCT/EP2013/071410

§ 371 (c)(1),
(2) Date: Apr. 7, 2015

(87) PCT Pub. No.: WO2014/060346

PCT Pub. Date: Apr. 24, 2014

(65) Prior Publication Data

US 2015/0277381 A1 Oct. 1, 2015

(30) Foreign Application Priority Data

Oct. 15, 2012 (CH) ..... 2003/12

(51) Int. Cl.
*G04B 17/28* (2006.01)

(52) U.S. Cl.
CPC ..... *G04B 17/285* (2013.01)

(58) Field of Classification Search
CPC ..... G04B 17/28; G04B 17/285
USPC ..... 368/127
See application file for complete search history.

(56) References Cited

U.S. PATENT DOCUMENTS 6,846,104 B2 * 1/2005 Geyer ..... G04B 27/004 368/127
7,004,619 B2 * 2/2006 Papi ..... G04B 17/285 368/127

(Continued)

FOREIGN PATENT DOCUMENTS

CH 696 450 A5 6/2007
EP 1 564 608 A2 8/2005

(Continued)

OTHER PUBLICATIONS

International Search Report for PCT/EP2013/071410 mailed Feb. 5, 2014.

(Continued)

*Primary Examiner* — Vit W Miska
(74) *Attorney, Agent, or Firm* — Koppel, Patrick, Heybl & Philpott

(57) ABSTRACT

The present invention relates to a timepiece comprising a frame, at least one driving gear (2), and at least one tourbillon mechanism including: a first cage (4) which can rotate about a first axis (A) and on which a balance (6) and an escapement gear are pivotably mounted, said escapement gear being formed by an escape wheel and an escape pinion; a second cage (8) rotatably movable about a second axis (B) and supporting the first cage (4); and a third cage (10) rotatably movable about a third axis (C), said third cage (10) supporting the first and second cages (4, 8) and kinematically driving same. Two of the first, second and third axes (A, B, C) are perpendicular to one another, with the remaining first, second or third axis (A, B, C) forming an angle other than 0° and 90° with one of the other two axes (A, B, C).

17 Claims, 3 Drawing Sheets

(56) References Cited

U.S. PATENT DOCUMENTS

| | | | | |
|---|---|---|---|---|
| 7,527,423 | B2 * | 5/2009 | Ruchonnet | G04B 17/285 368/127 |
| 7,677,793 | B2 * | 3/2010 | Lete | G04B 17/285 368/127 |
| 8,210,739 | B2 * | 7/2012 | Greubel | G04B 17/285 368/127 |
| 2005/0201209 | A1 * | 9/2005 | Golay | G04B 17/285 368/127 |
| 2006/0187760 | A1 * | 8/2006 | Kasapi | G04B 17/285 368/127 |

FOREIGN PATENT DOCUMENTS

| | | | |
|---|---|---|---|
| EP | 1 574 916 | A2 | 9/2005 |
| WO | WO 2004/077171 | A2 | 9/2004 |
| WO | WO 2005/071498 | A1 | 8/2005 |

OTHER PUBLICATIONS

"The first triple tourbillon" by Richard Good, F.B.H.I., Horological Journal, Apr. 1983, pp. 15-19.

* cited by examiner

TIMEPIECE

TECHNICAL FIELD

The present invention relates to mechanical timepieces. It more particularly relates to a timepiece comprising a frame, at least one driving wheel, such as a wheel of a going train, and at least one tourbillon mechanism comprising:

- a first cage rotatable around a first axis and on which are pivotally mounted a balance and an escapement mobile formed of an escapement wheel and an escapement pinion,
- a second cage rotatable around a second axis and supporting said first cage,
- a third cage rotatable around a third axis, said third cage supporting said first and second cages and driving them kinematically.

BACKGROUND OF THE INVENTION

A tourbillon mechanism is a device designed to average the running deviation of the positions of the balance of a timepiece. To that end, a tourbillon mechanism comprises a support (for example, a cage in the case of the traditional tourbillon) pivotally mounted on the frame, which is in general an assembly formed by a bridge and a plate and, pivotally mounted on this support, a sprung balance and an escapement comprising in particular an escapement wheel provided with a gear and a pinion. The support comprises a gear kinematically connected to the going train of the timepiece, in general to the third wheel, a toothed gear, mounted fixed on the frame, meshes with the escapement pinion. In this way, each time the balance is in position to receive a driving impulse from the escapement, the torque applied by the third wheel on the gearing causes the support to rotate slightly, the impulse at the balance being given by the escapement, whose wheel rotates by meshing of its pinion with the toothed wheel. The wheels and pinions are generally arranged and numbered such that the tourbillon performs one revolution per minute. Thus, when the timepiece is positioned vertically, the position of the dead-point of the balance performs one revolution per minute, which averages the running deviations in the vertical positions. However, the deviation between horizontal and vertical positions remains.

Various solutions have been proposed to offset this drawback.

For example, a tri-axial tourbillon is known, described in application EP 1,574,916, comprising a cage containing the balance and the escapement rotating according to an axis, the cage being mounted in a second cage so as to be able to rotate around another axis, the second cage in turn being rotatably mounted in a third cage rotating around a fixed axis relative to the timepiece, the three axes being perpendicular to one another. The tri-axial tourbillon is driven by a driving gear mounted on the plate of the timepiece, which drives a pinion secured to the third cage, and causes that cage to rotate around its axis, thus setting a pinion in rotation meshing with a crown-wheel fastened on the plate of the timepiece, which rotates the cage around its axis, the second cage setting the first cage in rotation around its axis by means of a crown-wheel and the seconds pinion secured to the third cage, and thus transmitting the energy from the driving wheel to the ensemble formed by the escapement pinion, the escapement wheel and the balance placed in the first cage.

Such a mechanism has the drawback of being bulky and not aesthetically pleasing due to the presence of several toothed crowns, appearing in particular on the dial side.

Also known is publication WO 2005/071498, which describes a tri-axial tourbillon having three axes perpendicular to one another. The tourbillon is pivoted radially using a device located at the periphery of its outer cage. Such a mechanism has a low impact resistance and is therefore very fragile.

Also known is the tri-axial tourbillon described in the publication "The first triple tourbillon" by Richard Good, F.B.H.I., Horological Journal, April 1983, pages 15-19, said tourbillon comprising three axes perpendicular to one another. The construction conceived by Richard Good nevertheless requires a major cantilever relative to the horizontal axis of rotation of the mechanism, which causes a non-negligible moment of inertia.

One solution to resolve this problem was proposed by Thomas Prescher in his Triple Axis Tourbillon work inspired by patent CH 696,450. This solution consists of using a counterweight to offset the cantilever. However, the counterweight is driven by the cages, which results in creating an additional torque that the system must overcome.

The known tri-axial tourbillon mechanisms therefore have elements that are harmful and counter to the expected characteristics of a tourbillon, namely having the lightest possible system in order to have as limited an inertia is possible, as well as good visibility of the latter.

One aim of the present invention is therefore to offset these drawbacks by proposing a timepiece comprising a tourbillon mechanism making it possible to decrease the moment of inertia of the system.

Another aim of the present invention is to propose a timepiece comprising a robust tourbillon mechanism, having a reduced bulk and improved aesthetic appearance.

BRIEF DESCRIPTION OF THE INVENTION

To that end, and according to the present invention, a timepiece is proposed comprising a frame, at least one driving wheel, such as a wheel of a going train, and at least one tourbillon mechanism comprising:

- a first cage rotatable around a first axis and on which are mounted a balance and an escapement mobile formed of an escapement wheel and escapement pinion,
- a second cage rotatable around a second axis and supporting said first cage,
- a third cage rotatable around a third axis, said third cage supporting said first and second cages and driving them kinematically.

According to the invention, two of the first, second and third axes are perpendicular to one another, the remaining axis of the first, second and third axes forming an angle different from 0° and 90° with one of the other two of the first, second and third axes.

This construction makes it possible to reduce the bulk of the tourbillon mechanism as well as its moment of inertia.

BRIEF DESCRIPTION OF THE DRAWINGS

The invention will be better understood upon reading the following description of an embodiment, provided as an example and made in reference to the drawings, in which.

DETAILED DESCRIPTION OF THE INVENTION

In the present description, the term "cooperate" refers both to a direct kinematic link between two elements and an indirect kinematic link between two elements, intermediate wheels or intermediate part(s) being provided between said two elements.

Figure 1:
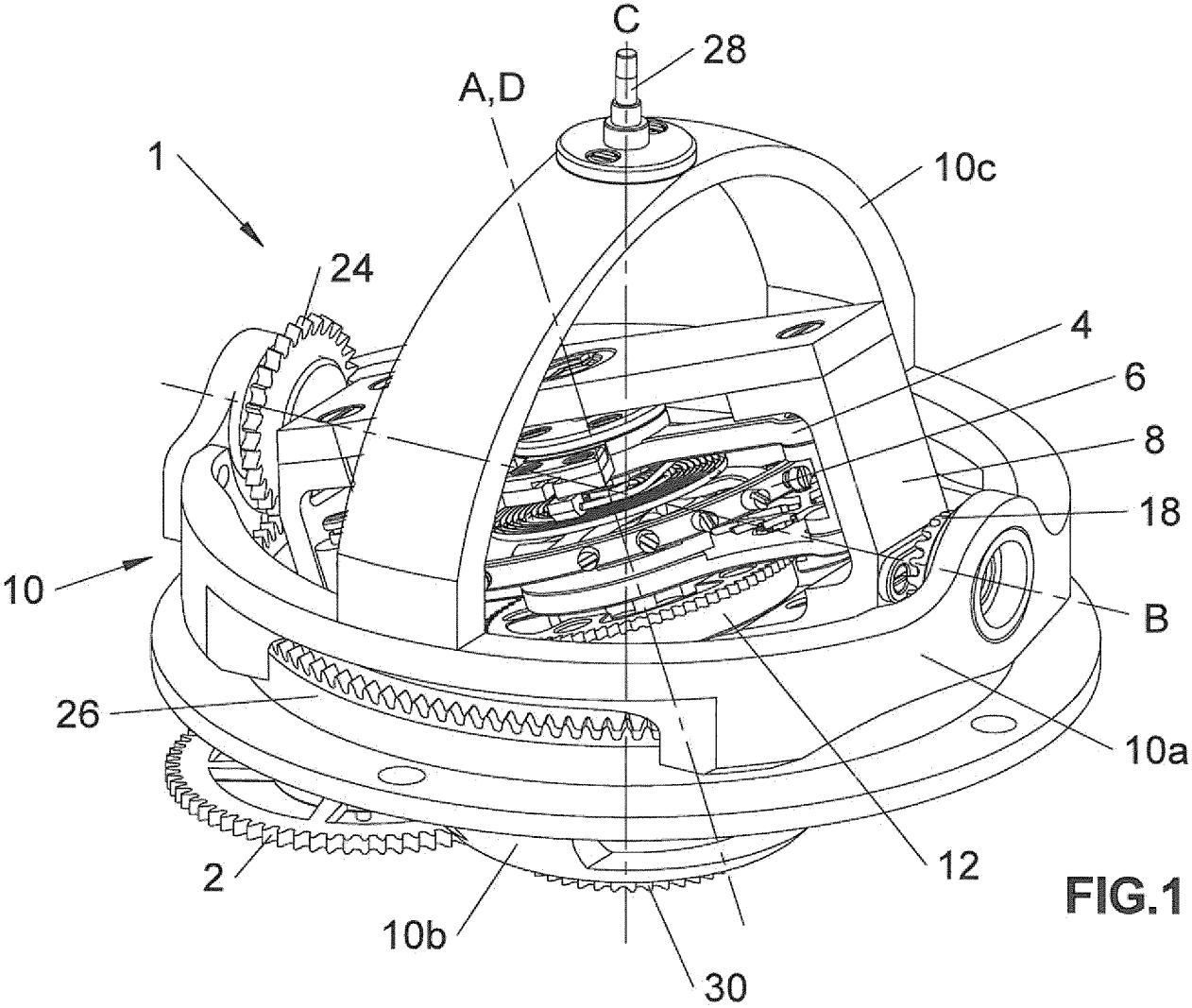
FIG. 1 shows a perspective view of a tourbillon mechanism according to the invention.
Figure 2:
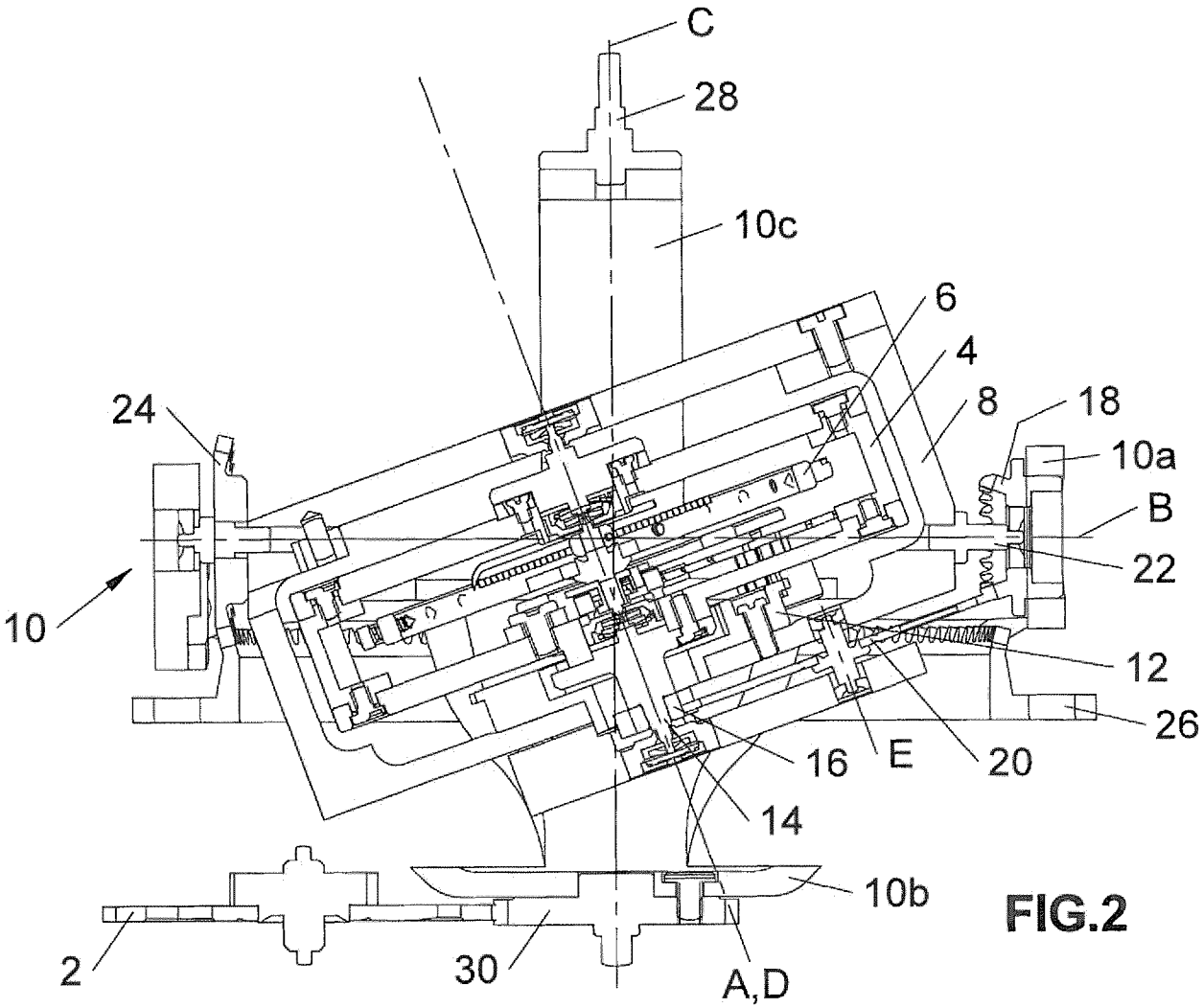
FIG. 2 shows a cutaway view of said tourbillon mechanism according to the invention.
Figure 3:
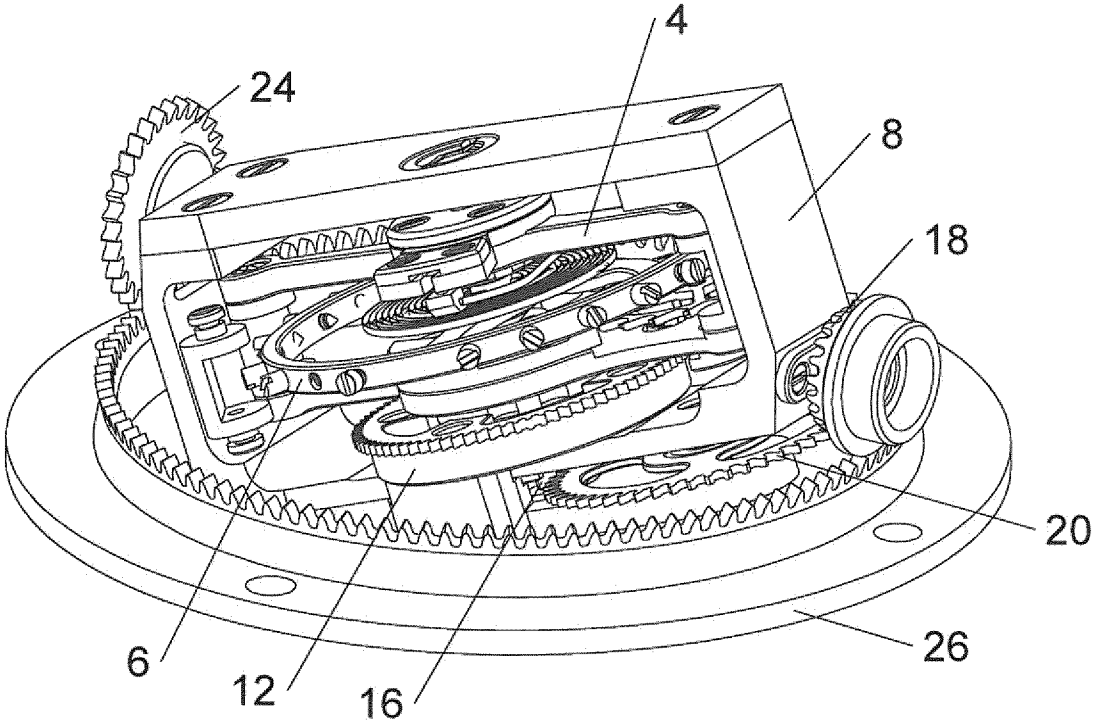
FIG. 3 shows a perspective view of the tourbillon mechanism according to the invention, the outer cage having been removed.

In reference to FIGS. 1 to 3, a tourbillon mechanism 1 is shown mounted on a frame of a timepiece according to the invention. Generally, the frame is an assembly formed by a bridge and a plate, but of course the frame may comprise any support element for the organs of the timepiece.

Pivotally mounted on the frame is a driving wheel 2, such as a wheel of a going train, for example the third wheel.

The tourbillon mechanism comprises a first cage 4 rotatable around a first axis A and on which are pivotally mounted a balance 6 and an escapement mobile, comprising an escapement wheel and escapement pinion (not shown). These elements as well as the other elements of the first cage 4 (anchor, other driving means of the balance) are known by those skilled in the art and will not be described in more detail here.

The tourbillon mechanism also comprises a second cage 8 rotatable around a second axis B and on which said first cage 4 is pivotally mounted around the first axis A.

The tourbillon mechanism also comprises a third cage 10 rotatably mounted on the frame around a third axis C, said third cage 10 supporting said first and second cages, 4 and 8, and kinematically driving them. The third cage 10 is pivoted at the center, and not at its periphery. This on the one hand makes it possible to reduce the bulk of the system, and on the other hand to decrease the torque to be applied to the system to cause it to rotate.

According to the invention, two of the first A, second B and third C axes are perpendicular one with respect to the other, the remaining axis of the first A, second B and third C axes forming an angle different from 0° and 90° with one of the other two of the first A, second B and third C axes.

Preferably, the remaining axis of the first A, second B and third C axes forms an angle comprised between 1° and 89°, preferably between 46° and 89°, and more preferably between 60° and 85°, with one of the other two of the first A, second B and third C axes.

Advantageously, the second axis B of the second cage 8 is perpendicular to the third axis C of the third cage 10, the first axis A of the first cage 4 forming, with the second axis B of the second cage, an angle comprised between 1° and 89°, preferably between 46° and 89°, and more preferably between 60° and 85°.

More particularly, the remaining axis from among the first A, second B and third C axes, and more specifically the axis A, forms an angle comprised between 1° and 89°, preferably between 5° and 85°, preferably between 10° and 80°, preferably between 30° and 80°, more preferably between 46° and 80°, and still more preferably between 60° and 80°, with one of the other two of the first A, second B and third C axes, and more specifically with the axis B.

According to one alternative embodiment, the balance 6 is pivotally mounted around a fourth axis D, said fourth axis D of the balance 6 forming an angle equal to 0° with the first axis A of the first cage 4.

According to another alternative embodiment, the balance 6 is mounted pivoting around a fourth axis D, said fourth axis D of the balance 6 forming an angle different from 0° with the first axis A of the first cage 4.

Advantageously, a first fixed wheel 12 is mounted secured on the second cage 8, said first fixed wheel 12 cooperating with the escapement pinion mounted in the first cage 4.

The first cage 4 comprises a first arbor 14 extending along the first axis A, said first arbor 14 being pivotally mounted on the second cage 8 and being secured with a first driving wheel 16 of the first cage 4. Furthermore, a second fixed wheel 18 is mounted secured on the third cage 10, said first driving wheel 16 of the first cage 4 cooperating with said second fixed wheel 18. This cooperation may be direct or indirect.

In the event said cooperation is indirect, at least one intermediate gear train 20 is provided that is mounted pivoting on the second cage 8, said intermediate gear train 20 kinematically connecting the second fixed wheel 18 to the first driving wheel 16 of the first cage 4. To this end, the second fixed wheel 18 and the intermediate train 20 form a conical gearing.

The axis of rotation E of the intermediate train 20 can be parallel to the axis D of the balance 6, as shown in FIG. 2. In another alternative, the axis of rotation D of the intermediate train 20 can be inclined relative to said axis D of the balance 6.

The second cage 8 comprises a second arbor 22 extending along the second axis B, said second arbor 22 being pivotally mounted on the third cage 10 and being secured to a second driving wheel 24 of the second cage 8. Furthermore, a third fixed wheel 26 is mounted secured on the frame, said second driving wheel 24 of the second cage 8 cooperating with said third fixed wheel 26. To this end, the second driving wheel 24 of the second cage 8 and the third fixed wheel 26 form a conical gearing. Of course, it is evident that according to the configuration of the mechanism, other types of non-conical gearings may be used.

Lastly, the third cage 10 comprises a third arbor 28 extending along the third axis C, said third arbor 28 being pivotally mounted on the frame and being secured to a third driving wheel 30 of the third cage 10 cooperating with the driving wheel 2 of the going train.

Of course, in another alternative that is not shown, the third cage could be pivotally mounted in a cantilever, i.e., its arbor 28 would be mounted pivoting on the frame on a single side, typically by the lower side, for example by means of a ball bearing. In the alternative illustrated here, the arbor 28 is mounted pivoting on the frame by both of its ends.

In the alternative illustrated here, the third cage 10 comprises a central part **10*a* circulating above the third fixed wheel 26, and a lower part 10*b* arranged so that the third driving wheel 30, positioned here at the end of said lower part 10*b*, cooperates with the driving wheel 2 of the going train. Of course, a reversed configuration can also be envisaged, in which the toothing of the third fixed wheel 26 would be oriented toward the lower part 10*b*, the central part then circulating below said third fixed wheel 26. The third cage 10 also comprises an upper part 10*c* advantageously having, in the alternative illustrated here, the form of an arch fastened to the central part 10*a*. The arch is thin, but rigid enough to maintain the system during a shock, which makes it possible to leave visible the first and second cages 4 and 8 placed inside the third cage 10. The third fixed wheel 26 is dimensioned such that the lower parts 10*b* of the third cage 10, and thus the second cage 8 and the elements supported by the second cage 8, can pivot and circulate inside said third fixed wheel 26**.

According to the alternative embodiments, the axis C of the third cage 10 can be parallel or inclined with respect to the axis of rotation of one of the wheels of the going train, and in particular the driving wheel 2.

Of course, the axis of rotation of the driving wheel of the going train also may or may not be perpendicular to the frame, the tourbillon mechanism then being positioned accordingly.

When the movement is operating, the driving wheel 2 of the going train is driven in a rotational movement so as to subject the first cage 4 to a driving torque by meshing with the third driving wheel 26 of the third cage 10.

In fact, when the wheel 2 is rotating, it is able to drive the rotation of the third cage 10 with it by means of the third driving wheel 30.

During this movement, the second driving wheel 24 of the second cage 8 supported by the third cage 10 is able to mesh with the third fixed wheel 26 to rotate the second cage 8.

During this movement, the intermediate gear train 20, supported by the second cage 8, can mesh with the second fixed wheel 18 secured to the third cage 10, in order to rotate the first driving wheel 16 of the first cage 14 and therefore to rotate the first cage 4.

However, since the escapement pinion is engaged with the toothing of the first fixed wheel 12, the driving torque can only create movement of the first cage 4 when the escapement gives a driving impulse to the balance, according to the traditional operation of an escapement.

The construction according to the invention makes it possible to produce a tourbillon mechanism having a reduced moment of inertia relative to the axis B. In fact, having an angle different from 90° between the axes of the first cage 4 and the second cage 8 results in bringing the system toward the center of gravity of the tourbillon mechanism. Considering the configuration of the mechanism according to the invention, one can see that there is more weight in the lower part of the system and that by inclining it (i.e., by having the angle between the axes A and B be different from 0° and 90°), one decreases the moment of inertia relative to the axis B. In fact, in a timepiece similar to the invention but in which the axes A and B are perpendicular, the moment of inertia relative to the axis B is 14.95 $g \cdot mm^2$. In a timepiece according to the invention, in which there is an angle of 70° between the axes A and B, the moment of inertia relative to the axis B is 14.25 $g \cdot mm^2$, i.e. a decrease in the moment of inertia relative to the axis B of 4.68%. This is intended to reduce the resistance to rotating the second cage 8 and thereby to favor the operation of the system relative to the known systems in which the axes are all perpendicular to each other. The cage 8 will rotate around its axis B with greater ease than if its axis of rotation B were perpendicular to the axis A of the cage 4. Furthermore, it is possible to use a counterweight with a very reduced size relative to the counterweights used in the prior art, or even to eliminate such a counterweight.

The construction according to the invention also makes it possible to produce a tourbillon mechanism having a reduced bulk, in particular due to the inclination of the angle E of the intermediate train 20 relative to the axis C of the third cage 10. In fact, if the axis D is inclined relative to the axis C, then the diameter of the second fixed wheel 18 can be reduced. Furthermore, by inclining the axis D of the balance 6 relative to the axis A of the first cage 4, it is possible, by finding the right compromise in the size of the balance and the distance between the balance and the cage, to further decrease the size of the first cage 4 and thus make the system even more compact.

The tourbillon mechanism according to the invention is robust and also has very good impact resistance.

Of course, the present invention is not limited to the described embodiment. In particular, it is possible to vary the shape of the cages, as well as the type of escapement, such as a detent escapement.

The invention claimed is:

1. A timepiece comprising a frame, at least one driving wheel, and at least one tourbillon mechanism comprising:

a first cage rotatable around a first axis and on which are mounted a balance and an escapement mobile formed of an escapement wheel and escapement pinion, a second cage rotatable around a second axis and supporting said first cage, a third cage rotatable around a third axis, said third cage supporting said first and second cages and driving them kinematically, wherein two of the first, second and third axes are perpendicular to one another and in that the remaining axis of the first, second and third axes forms an angle different from 0° and 90° with one of the other two of the first, second and third axes.

2. Timepiece according to claim 1, wherein the remaining axis of the first, second and third axes forms an angle comprised between 1° and 89°, preferably between 46° and 89°, and more preferably between 60° and 85°, with one of the other two of the first, second and third axes.

3. Timepiece according to claim 1, wherein the second axis of the second cage is perpendicular to the third axis of the third cage, and in that the first axis of the first cage forms, with the second axis of the second cage, an angle comprised between 1° and 89°, preferably between 46° and 89°, and more preferably between 60° and 85°.

4. Timepiece according to claim 2, wherein the second axis of the second cage is perpendicular to the third axis of the third cage, and in that the first axis of the first cage forms, with the second axis of the second cage, an angle comprised between 1° and 89°, preferably between 46° and 89°, and more preferably between 60° and 85°.

5. Timepiece according to claim 1, wherein the balance is pivotally mounted around a fourth axis, said fourth axis of the balance forming an angle equal to 0° with the first axis of the first cage.

6. Timepiece according to claim 2, wherein the balance is pivotally mounted around a fourth axis, said fourth axis of the balance forming an angle equal to 0° with the first axis of the first cage.

7. Timepiece according to claim 1, wherein the balance is pivotally mounted around a fourth axis, said fourth axis of the balance forming an angle different from 0° with the first axis of the first cage.

8. Timepiece according to claim 2, wherein the balance is pivotally mounted around a fourth axis, said fourth axis of the balance forming an angle different from 0° with the first axis of the first cage.

9. Timepiece according to claim 1, wherein a first fixed wheel is mounted secured on the second cage, said first fixed wheel cooperating with the escapement pinion.

10. Timepiece according to claim 2, wherein a first fixed wheel is mounted secured on the second cage, said first fixed wheel cooperating with the escapement pinion.

11. Timepiece according to claim 1, wherein the first cage comprises a first arbor extending along the first axis, said first arbor being pivotally mounted on the second cage and being secured with a first driving wheel of the first cage, and in that a second fixed wheel is mounted secured on the third cage, said first driving wheel of the first cage cooperating with said second fixed wheel.

12. Timepiece according to claim 2, wherein the first cage comprises a first arbor extending along the first axis, said first arbor being pivotally mounted on the second cage and being secured with a first driving wheel of the first cage, and in that a second fixed wheel is mounted secured on the third cage, said first driving wheel of the first cage cooperating with said second fixed wheel.

13. Timepiece according to claim 7, wherein an intermediate gear train is pivotally mounted on the second cage, said intermediate gear train kinematically connecting the second fixed wheel to the first driving wheel of the first cage.

14. Timepiece according to 1, wherein the second cage comprises a second arbor extending along the second axis, said second arbor being pivotally mounted on the third cage and being secured to a second driving wheel of the second cage, and in that a third fixed wheel is mounted secured on the frame, said second driving wheel of the second cage cooperating with said third fixed wheel.

15. Timepiece according to claim 2, wherein the second cage comprises a second arbor extending along the second axis, said second arbor being pivotally mounted on the third cage and being secured to a second driving wheel of the second cage, and in that a third fixed wheel is mounted secured on the frame, said second driving wheel of the second cage cooperating with said third fixed wheel.

16. Timepiece according to claim 1, wherein the third cage comprises a third arbor extending along the third axis, said third arbor being pivotably mounted on the frame and being secured to a third driving wheel of the third cage cooperating with the driving wheel.

17. Timepiece according to claim 2, wherein the third cage comprises a third arbor extending along the third axis, said third arbor being pivotably mounted on the frame and being secured to a third driving wheel of the third cage cooperating with the driving wheel.

* * * * *